United States Patent [19]

Sarin

[11] 4,398,611

[45] Aug. 16, 1983

[54] MINING DRILL

[75] Inventor: Vinod K. Sarin, Lexington, Mass.

[73] Assignee: GTE Products Corporation, Stamford, Conn.

[21] Appl. No.: 346,972

[22] Filed: Feb. 8, 1982

[51] Int. Cl.[3] ..... E21B 10/02

[52] U.S. Cl. ..... 175/413; 175/410; 175/393

[58] Field of Search ..... 175/413, 410, 393, 320; 279/20; 285/404

[56] References Cited

U.S. PATENT DOCUMENTS

| | | | |
|---|---|---|---|
| 3,187,825 | 6/1965 | Bower, Jr. | 175/410 |
| 3,415,332 | 12/1968 | Bower, Jr. | 175/410 |
| 4,190,128 | 2/1980 | Emmerich | 175/410 |

*Primary Examiner*—Stephen J. Novosad
*Assistant Examiner*—Thuy M. Bui
*Attorney, Agent, or Firm*—Robert E. Walter

[57] ABSTRACT

In a mine tool of the type having a drive body holding a bit, the drive body includes a pair of forwardly projecting flanges forming air passages in proximity to the cutting edges for the conveyance of detritus.

4 Claims, 9 Drawing Figures

MINING DRILL

FIELD OF INVENTION

The present invention relates to a mining drill which is particularly useful for drilling coal mine roof bolt holes.

BACKGROUND OF INVENTION

Roof drills are used for drilling holes in rock in the roof of mines for installing roof bolts. The drills are typically in the form of a drive body having a bit at the forward end with a hard wear-resistant material, such as tungsten carbide rigidly secured to the bit.

U.S. Pat. No. 4,190,128 to Emmerich relates to a roof drill having openings in the bit which connect to a hole in the drive body for the passage of air and removal of detritus.

U.S. Pat. No. 3,032,129 to Fletcher et al relates to a drill bit wherein the air is drawn into the drive body through open portions on each side of the bit.

U.S. Pat. No. 3,434,552 to Bower, Jr. relates to a bit having a slot with a cutting insert loosely held within the slot for free endwise sliding movement relative to the slot.

SUMMARY OF INVENTION

During drilling it is desirable to remove detritus, which is comprised of dust, cuttings and bit fragments generated during drilling due to the drilling action of the cutting insert. Inadequate removal results in an increase in the torque required to rotate the mining drill. Suction is typically applied through a passage in the drive body so that detritus can be removed from the hole being drilled.

In accordance with the present invention, there is provided a mine drill for aiding the collection of detritus during drilling comprising a drive body being cylindrically shaped about an axis of rotation and having an axial passage for the flow of detritus, a bit mounted at the forward end of said drive body for movement about said axis of rotation, said bit comprising a body portion including a pair of support lands projecting there from in the axial direction and an elongated insert having forwardly projecting cutting edges and a base surface secured to said body portion, said base surface lying in a plane substantially normal to the axis of rotation, each support land being offset said axis of rotation and secured to respective opposite sides of said insert whereby during rotation of said bit leading insert surfaces are substantially unobstructed and trailing insert surfaces are mounted to respective support lands, said insert having end portions extending in a radial direction outwardly of said body portion and said drive body, said drive body having a pair of forwardly projecting flanges forming diametrically opposed apertures, each aperture receiving a respective end portion, each flange extending forwardly of said plane and spaced from respective opposite sides of said insert; a pair of passages adapted for the conveyance of detritus during drilling to said axial passage, each passage being formed in proximity to a respective cutting edge by a respective leading insert surface and a respective flange extending forwardly of said plane.

Also, in accordance with the present invention there is provided a drive body for a bit having diametrically opposed apertures and forwardly projecting flanges.

DRAWINGS

DETAILED DESCRIPTION

Figure 1:
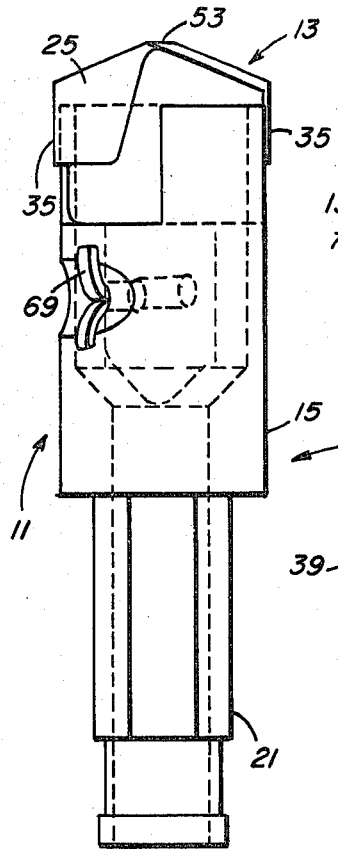
FIG. 1 is a side elevational view of the drill including bit mounted on the drive body.

FIG. 1 generally illustrates a mining drill 11 comprising a bit 13 mounted on a drive body 15 having an axial passage 17 for the flow of detritus from the cutting area. The drive body 15, is cylindrically shaped and capable of being mounted for movement about an axis of rotation 19. As illustrated in FIG. 1, the rearward end 21 has a hexagonal shape of reduced dimension forming a socket end which can be attached to another drive body having an air passage with a mating hexagonal recess. Multiple drive bodies can be conveniently connected to a drilling machine and vacuum source of a conventional type.

The terms forward and rearward are used for convenience of description and should not be taken as limiting the scope of the invention. For purposes of this description, forward generally refers to axial direction in which the drill is advanced during cutting and rearward is the opposite direction.

A bit 13 which is attached to the forward end 23 of the drive body includes an insert 25 rigidly attached thereto for movement about the axis of rotation 19. The insert 25 has forwardly projecting lands 27 which form an angle of from about 135° to about 145° and a rectangular base surface 29. Side surfaces 31 extend from respective ends of the base surface 29 toward the forward lands 27 intermediate the end portions 35 of the insert 25. The forward lands 27 meet substantially at the axis of rotation 19 and slope downwardly from the cutting edges 33 in opposite directions on either side of the point at an angle of about 8° to about 12°. The cutting edges 33 are located above the two diagonally opposite corners of the rectangular base surface 29.

During rotation of the insert 25 during cutting, the cutting edges 33 lead the insert 25 so as to make primary cutting contact with the work, i.e. roof rock. For purposes of this description leading surfaces or edges are intended to refer to edges or surfaces which are first presented to the work in the direction of rotation.

The body portion 37 of the bit 13 includes a slot 39 which extends diametrically across the body portion 37 so as to form flat support surface 43 normal to the axis of rotation 19 of the bit 13. The body portion 37 further includes a pair of support lands 45 which project forwardly of the flat surface 43 in the axial direction so as to form vertical surfaces 47 which are the respective inner surfaces of the slot 39. As illustrated in detail in the drawings, a pair of vertical surfaces 47 are positioned in diagonally opposite sides of the slot 39. Each of the respective support lands 45 is offset the axis of rotation 19 and secured to respective opposite side surfaces 31 of the insert 25 whereby during rotation of the bit 13, leading insert surfaces 49 are substantially unobstructed and trailing insert 51 surfaces are mounted to respective support lands 45. The body portion 37 of the bit 13 may be conveniently formed by forging or precision casting and the slot 39 subsequently milled.

The insert 25 is mounted to the body portion 37 so that end portions 35 extend through the slot 39 in a radial direction outwardly of the body portion 37 and the drive body 15. Preferably the point 53 of the insert 25 is axially aligned with the axis of rotation 19 and the insert 25 is fixedly held in position in the slot 39 with the base surface 29 secured to the flat surface 43 and respective side surfaces 31 secured to respective vertical surfaces 47. Typically the securing is by brazing. The radial projection of the end portions 35 beyond the support lands 45 and the drive body 15 creates a hole slightly larger than the dimensions of the drive body 15. The radial outer dimensions of the lands 45 preferably match the outer dimensions of the drive body 15. Thus, during drilling, air is supplied or drawn into the drill hole by suction along the exterior of the drive body 15.

The bit 13 is mounted to the drive body 15 so that torque and axial forces are transmitted directly from the drive body 15 to the bit 13. The drive body 15 has an inner surface 55 which is substantially concentric with the outer cylindrical shape with an interiorly positioned seating member 57 extending radially inward from the inner surface 55. The bottom surface 59 of the bit 13 engages and is supported by the seating member 57 so that the rearward forces on the bit 13 during drilling causes by the forward thrust of the bit 13 against the work is transmitted to the drive body 15. The body portion 37 includes a depending shank 61 having a rectangular shape for mating in a matching rectangularly shaped opening 63 in the seating member 57 for transmitting torque from the drive body 15 to the bit 13. A bore 65 in the shank 61 is aligned with opposing holes 67 in the drive body 15 so that a pin 69 passing through the bore 65 and holes 67 prevent forward withdrawal of the bit 13.

Preferably the shank 61 is skewed with respect to the lengthwise direction of the cutting insert. As illustrated in the drawings, the skew is an angle of about 45° so that the pin 69 passing through the shank 61 and the holes 67 are aligned with the diametrically opposed quadrants of the support lands 45.

Figure 2:
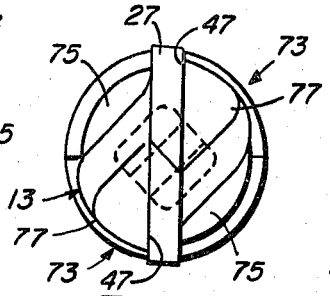
FIG. 2 is an end elevational view of the drill of FIG. 1.
Figure 3:
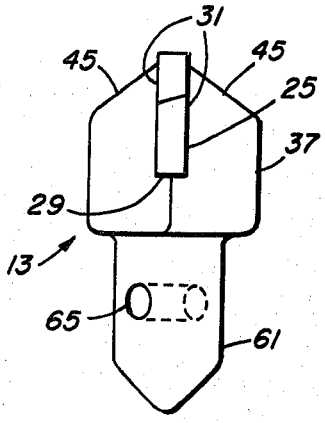
FIG. 3 is an end view of the bit.
Figure 4:
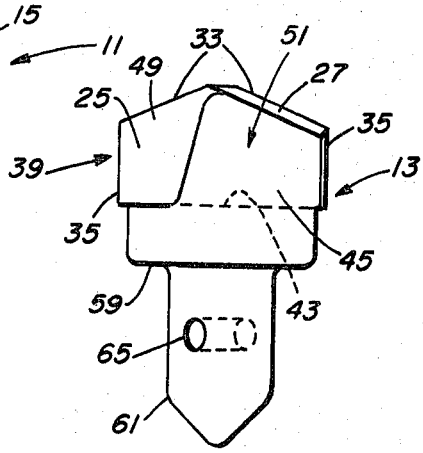
FIG. 4 is a side view of the bit of FIG. 3.
Figure 5:
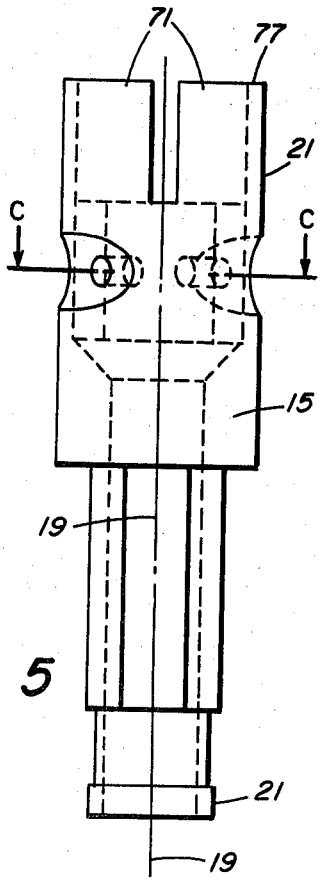
FIG. 5 is a side view of the drive body.
Figure 7:
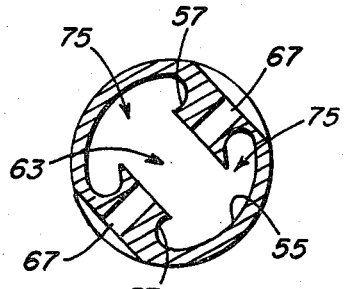
FIG. 7 is a sectional view along section C—C of FIG. 5.
Figure 6:
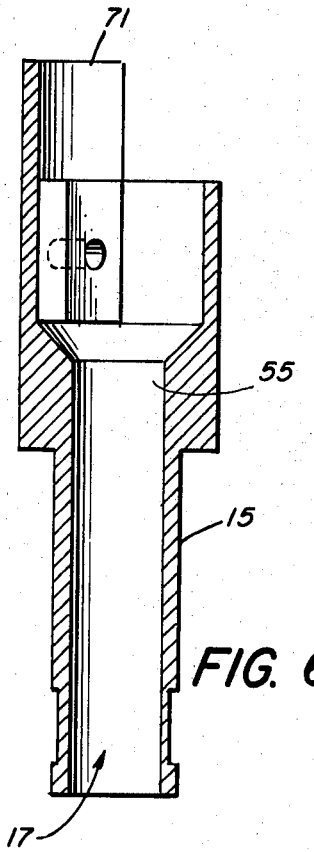
FIG. 6 is a sectional view of the drive body.
Figure 8:
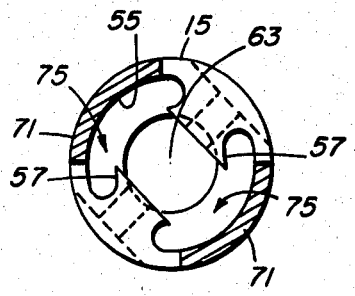
FIG. 8 is an end elevational view of the drive body showing flanges in section.
Figure 9:
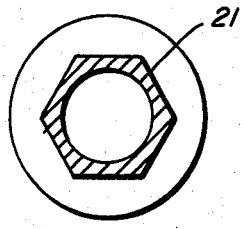
FIG. 9 is a rear elevational view of the drive body.

In accordance with the principles of the present invention, the drive body 15 includes a pair of forwardly projecting flanges 71 forming diametrically opposed apertures 73. Each of the apertures 73 is adapted to receive one of the respective end portions 35. The flanges 71 which are diametrically opposed extend in a direction forward of the plane of the base surface 29 of the insert 25 when the bit 13 is mounted to the drive body 15. Each of the flanges 71 is spaced from a respective side surface 31 so as to form a respective air passage 75 adapted for the conveyance of detritus during drilling to the axial passage 17. As illustrated in FIG. 2, each of the aperatures 73 are sufficiently large along the circumferential direction to accommodate the portion of respective support lands 45 which project in the radial direction beyond the inner surface 55.

As illustrated in the drawings, the flanges 71 are preferably an extension of the tubular shape of the drive body 15 formed by the concentric inner surface 55 and outer cylindrical shape. The flanges 71 have a forward end in a plane normal to the axis of rotation. Each of the flanges 71 extend forwardly to a position intermediate the insert base surface 29 and the most rearward position of the cutting edges 33. From a side view of the insert 25, the most rearward position of the cutting edges 33 is along a plane passing through the most rearward portions of each of the cutting edges 33. Preferably the upper surface of the flanges 71 are forwardly closer to the most rearward portion of the cutting edges 33 than midway the plane of the base surface 29 and the plane of the cutting edges 33. The air passages 75 are thusly positioned closely adjacent the cutting edges 33 of the bit 13 so that air sucked in adjacent the exterior of the drive body 15 preferably reverses direction, increases velocity and forces detritus through the air passages 75.

In the area adjacent the cutting edges 33, the respective air passages 75 in diametrically opposed quadrants are formed by respective unobstructed leading insert surfaces 49, the interior surface of the respective flanges 71, and the outer surface 77 of the respective support lands 45. Each of the respective support lands 45 which are in diametrically opposed quadrants have outwardly facing surfaces 77 that are within the confines of the drive body 15. Preferably each of the support lands 45 extend along the face of the insert 25 from an area spaced from the end of the insert 25 to about the midpoint of the insert 25.

INDUSTRIAL APPLICABILITY

The mining drills are particularly useful for drilling coal mine roof bolt holes.

I claim:

1. A mine drill for aiding the collection of detritus during drilling comprising a drive body being cylindrically shaped about an axis of rotation and having an axial passage for the flow detritus, a bit mounted at the forward end of said drive body for movement about said axis of rotation, said bit comprising a body portion including a pair of support lands projecting therefrom in the axial direction and an elongated insert having forwardly projecting cutting edges and a base surface secured to said body portion, said base surface lying in a plane substantially normal to the axis of rotation, each support land being offset said axis of rotation and secured to respective opposite sides of said insert whereby during rotation of said bit leading insert surfaces are mounted to respective support lands, said insert having end portions extending in a radial direction outwardly of said body portion and said drive body, said drive body having a pair of forwardly projecting flanges forming diametrically opposed apertures, each aperture receiving a respective end portion, each flange extending forwardly of said plane and spaced from respective opposite sides of said insert, a pair of passages adapted for the conveyance of detritus during drilling to said axial passage, each passage being formed in proximity to a respective cutting edge by a respective leading insert surface and a respective flange extending forwardly of said plane.

2. A mine drill according to claim 1 wherein said drive body includes an inner surface and a seating member extending radially inward from said inner surface for supporting and transmitting torque from said drive body to said bit.

3. A mine drill according to claim 2 which said bit includes a depending shank having a rectangular shape for mating with said seating member.

4. A drive body for holding a bit for rotation about an axis during drilling wherein the bit is the type having a body portion with a pair of forwardly projecting support lands and an elongated insert having forwardly projecting cutting edges and a base surface secured to the body portion whereby during rotation leading insert surfaces are substantially unobstructed and trailing insert surfaces are mounted to respective support lands, said drive body comprising a pair of forwardly projecting flanges forming diametrically opposed apertures, each aperture being adapted to receive a respective end portion of said insert, said drive body having an inner surface and a seating member extending radially inward from the inner surface adapted to support and transmit torque from the drive body to the bit, each flange being adapted to extend forwardly of said base surface when said bit is mounted on said seating members, said drive member having an axial passage adapted to communicate with a pair of passages formed with a respective flange when said bit is mounted on said seating member for the conveyance of detritus.

* * * * *